US006646379B1

(12) United States Patent
Nohara et al.

(10) Patent No.: US 6,646,379 B1
(45) Date of Patent: Nov. 11, 2003

(54) METAL VAPOR DISCHARGE LAMP HAVING CERMET LEAD-IN WITH IMPROVED LUMINOUS EFFICIENCY AND FLUX RISE TIME

(75) Inventors: Hiroshi Nohara, Hyogo (JP); Yoshiharu Nishiura, Shiga (JP); Shunsuke Kakisaka, Osaka (JP); Kazuo Takeda, Osaka (JP); Kenji Akiyoshi, Osaka (JP); Kouichi Sugimoto, Osaka (JP); Shiki Nakayama, Osaka (JP); Takashi Yamamoto, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/469,970

(22) Filed: Dec. 21, 1999

(51) Int. Cl.[7] ..... H01J 61/36; H01J 61/20

(52) U.S. Cl. ..... 313/623; 313/624; 313/625; 313/634; 313/42; 313/43

(58) Field of Search ..... 313/623, 624, 313/625, 634, 27, 42, 43

(56) References Cited

U.S. PATENT DOCUMENTS

| | | | | |
|---|---|---|---|---|
| 2,765,420 A | | 10/1956 | Martt | |
| 2,765,720 A | | 10/1956 | Martt | |
| 4,105,908 A | | 8/1978 | Harding et al. | |
| 4,475,061 A | | 10/1984 | Van de Weijer et al. | |
| 4,539,511 A | * | 9/1985 | Denbigh et al. | 313/624 |
| 4,651,048 A | * | 3/1987 | Liebe | 313/25 |
| 4,808,881 A | * | 2/1989 | Kariya et al. | 313/524 |
| 4,910,430 A | | 3/1990 | Ito et al. | |
| 5,357,167 A | | 10/1994 | Mathews et al. | |
| 5,424,609 A | | 6/1995 | Geven et al. | |
| 5,552,670 A | | 9/1996 | Heider et al. | |
| 5,557,169 A | | 9/1996 | Van Lierop et al. | 313/623 |
| 5,598,063 A | | 1/1997 | Mathews et al. | 313/623 |
| 5,654,606 A | | 8/1997 | Weijtens et al. | |
| 5,680,000 A | * | 10/1997 | Zuk et al. | 313/25 |

(List continued on next page.)

FOREIGN PATENT DOCUMENTS

| | | | |
|---|---|---|---|
| EP | 0 286 247 | 12/1988 | |
| EP | 4-99662 | 8/1992 | H01J/61/36 |
| EP | 0 639 853 | 2/1995 | |
| EP | 0 056 115 | 5/1999 | |

(List continued on next page.)

OTHER PUBLICATIONS

European Search report.
"Product Catalog" and its partial English Translation.

*Primary Examiner*—Nimeshkumar D. Patel
*Assistant Examiner*—Sikha Roy
(74) *Attorney, Agent, or Firm*—Merchant & Gould P.C.

(57) ABSTRACT

A metal vapor discharge lamp having a highly reliable sealed portion. The lamp has an arc tube including a discharge portion of translucent ceramic in which a discharge metal is filled and a pair of electrodes is disposed; small tubular portions coupled to both ends of the discharge portion; feeder bodies inserted into the small tubular portions; and a sealing material sealing the gap between the feeder body and the small tubular portion at the end portion opposite to the discharge portion. The end of the small tubular portions and the inner surface of the discharge portion define a discharge space. The feeder bodies are composed of a conductive cermet and connected to the electrodes. The ends of the feeder bodies extend at least to the ends of the small tubular portions. The temperature of the end of the sealing material on the discharge space side during the lamp operation is not more than 800° C.

7 Claims, 6 Drawing Sheets

U.S. PATENT DOCUMENTS

| | | | | | |
|---|---|---|---|---|---|
| 5,708,328 | A | * | 1/1998 | Mathews et al. | 313/573 |
| 5,742,124 | A | * | 4/1998 | Kees et al. | 313/625 |
| 5,742,125 | A | | 4/1998 | Ruigrok | |
| 5,751,111 | A | | 5/1998 | Stoffels et al. | 313/606 |
| 5,856,726 | A | | 1/1999 | Evans et al. | |
| 5,905,341 | A | | 5/1999 | Ikeuchi et al. | |
| 5,973,453 | A | * | 10/1999 | Van Vliet et al. | 313/606 |
| 6,137,230 | A | * | 10/2000 | Born et al. | 313/620 |
| 6,232,719 | B1 | | 5/2001 | Kaneko et al. | 313/625 |
| 6,362,569 | B1 | * | 3/2002 | Wijenberg et al. | 313/634 |

FOREIGN PATENT DOCUMENTS

| | | | | | |
|---|---|---|---|---|---|
| EP | 1 056 115 | | 5/1999 | | |
| JP | 48-25383 | | 4/1973 | | |
| JP | 55-136449 | | 10/1980 | | |
| JP | 57-78763 | | 5/1982 | | |
| JP | 58-59555 | | 4/1983 | | |
| JP | 60-63869 | * | 4/1985 | | H01J/61/073 |
| JP | 61-245457 | A | 10/1986 | | |
| JP | 62-283543 | | 12/1987 | | |
| JP | 2-94352 | | 4/1990 | | H01J/61/82 |
| JP | 6-89699 | | 3/1994 | | |
| JP | 6-196131 | | 7/1994 | | |
| JP | 7-21981 | | 1/1995 | | |
| JP | 7-21983 | | 1/1995 | | |
| JP | 7-94142 | | 4/1995 | | |
| JP | 7-240184 | A | 9/1995 | | |
| JP | 9-92204 | | 4/1997 | | |
| JP | 9-129178 | | 5/1997 | | |
| JP | 10-134765 | | 5/1998 | | H01J/61/20 |
| JP | 10-134768 | | 5/1998 | | |
| JP | 11-96973 | | 4/1999 | | |
| JP | 2000-285849 | | 10/2000 | | |

* cited by examiner

METAL VAPOR DISCHARGE LAMP HAVING CERMET LEAD-IN WITH IMPROVED LUMINOUS EFFICIENCY AND FLUX RISE TIME

FIELD OF THE INVENTION

The present invention relates to a metal vapor discharge lamp using a translucent ceramic arc tube.

BACKGROUND OF THE INVENTION

This kind of conventional metal vapor discharge lamp is disclosed, for example, in Publication of Japanese Patent Application No. Hei 6-196131 A (conventional lamp 1), No. Hei 7-240184 A (conventional lamp 2), or No. Sho 61-245457 A (conventional lamp 3), etc.

The conventional lamp 1 includes, as shown in FIG. 6, a translucent ceramic arc tube 11 and small tubular portions 12*a*, 12*b* provided at both sides of the central main tube portion 13 of the arc tube 11. Inside the small tubular portions 12*a*, 12*b*, feeder bodies 14*a*, 14*b* are inserted. The feeder bodies 14*a*, 14*b* are connected to electrodes 15*a*, 15*b*, respectively. The feeder bodies 14*a*, 14*b* are made of a hydrogen permeable material 16*a*, 16*b* and a halide-resistant material 17*a*, 17*b*. The gap between the small tubular portions 12*a*, 12*b* and the feeder bodies 14*a*, 14*b* is sealed with a glass frit 18*a*, 18*b*.

As the hydrogen permeable material 16*a*, 16*b*, niobium, tantalum, or the like, are used, which makes it possible to bring the coefficient of thermal expansion closer to that of alumina that is the material for the small tubular portions 12*a*, 12*b*, so as to prevent the occurrence of cracks at the time of sealing. However, niobium etc. is vigorously reacted with a halide that is filled in the main tube portion. Therefore, the halide-resistant material 17*a*, 17*b* such as tungsten, molybdenum or a conductive cermet, etc. is used for the member at the portion where the filled material exists during the lamp operation, while the hydrogen permeable portion 16*a*, 16*b* made of niobium is completely sealed with the glass frit 18*a*, 18*b*. Thus, this configuration inhibits the reaction between the feeder body 14*a*, 14*b* and the filled material.

The conventional lamp 2 includes, as shown in FIG. 7, a translucent ceramic arc tube 19, plug bodies 20 and a pair of electrodes 21. The arc tube 19 includes a central bulging portion 22 having a spherical or an elliptic spherical shape, and small tubular portions 23 having a diameter smaller than that of the central bulging portion 22. The small tubular portions 23 extend from both ends of the bulging portion 22, and the small tubular portions 23 and the central bulging portion 22 are formed in one piece. Each plug body 20 is inserted into the small tubular portion 23 and has a conducting means conducting from the inside to outside of the arc tube. The electrodes 21 are provided in the bulging portion 22 and supported by one end of the plug bodies 20, respectively.

In this configuration, an external lead wire 24 that passes through the inside of the plug body 20 conducts from the inside to outside of the arc tube 19. The plug body 20 is bonded to the small tubular portion 23 with glass adhesive 25 made of, for example, a frit glass, which are poured into the gap between the inner surface of the end of the small tubular portions 23 at the opposite side to the electrode 21 and the outer surface of the plug body 20. Furthermore, mercury as a buffer metal, a metal halide as a discharge metal, noble gas such as argon gas, etc. are filled in the arc tube. The filled amount of the metal halide is larger than the amount that evaporates during the lamp operation.

In general, when the temperature of the glass adhesive 25 increases during the lamp operation, the glass adhesive 25 deteriorates due to a chemical reaction with a metal halide. This deterioration causes the occurrence of leaks of the sealed materials from the arc tube. During the lamp operation, in the conventional lamp 2, excess metal halides are condensed in the gap between the inner surface of the small tubular portion 23 and the outer surface of the plug body 20 except for the bonding portion with the glass adhesive 25. This condensed metal halide thermally isolates the glass adhesive 25 from a high temperature gas inside the discharge space. Thus, the deterioration of the glass adhesives 25 due to the chemical reaction with metal halides can be prevented and the occurrence of leaks in the arc tube 19 is prevented.

Furthermore, the conventional lamp 3 has. as shown in FIG. 8, an arc tube including a translucent alumina tube 26, the ends of which are plugged with conductive cermet 27 via a sealing material 28, and dysprosium halide is filled in the arc tube. As a main component of the sealing material 28, an oxide of rare earth metal is used. The conductive cermet 27 is obtained by sintering a mixture of tungsten powder, etc. and aluminum powder, etc., used for the discharge material. Therefore the conductive cermet 27 has the coefficient of thermal expansion that is very close to that of aluminum, so that cracks in the sealed portion can be reduced. Furthermore, since the metal oxide of rare earth metal is used as a main component of the sealing material 28, the reaction between the filled material and the sealing material 28 can be inhibited during the lamp operation.

In the configuration of the conventional lamp as described above, when a metal such as tungsten, molybdenum, or the like, whose coefficient of thermal expansion is different from that of aluminum is used, cracks easily occur in the sealed portion, and leaks easily occur in the arc tube at the step of sealing and during the lamp operation. In order to avoid such disadvantages, it is preferable that the conductive cermet whose coefficient of thermal expansion is close to that of aluminum is used for the halide-resistant portion. However, it is difficult to bond the conductive cermet to niobium as the hydrogen permeable material. Therefore, the reliability in this portion is not obtained and the utilization factor of the feeder body is lowered.

Furthermore, when a metal such as niobium, etc. is used for the feeder body, since the bonding at the interface between niobium and the glass frit is weaker than the bonding at the interface between the glass frit and alumina, i.e. between two oxides, the filled materials gradually leak from the interface between niobium and the glass frit. As a result, the lamp voltage is lowered.

Furthermore, since the coefficient of thermal expansion of niobium is $7.2\times10^{-6}$, and the coefficient of thermal expansion of alumina is $8.0\times10^{-6}$, not a little thermal stress occurs at the time of sealing and during the lamp operation. Therefore, in a high power lamp having an electrode rod of a large diameter, the thermal stress is too large to be neglected and cracks occur in the sealed portion. Furthermore, niobium is embrittled due to the reaction with nitrogen at high temperatures. Therefore, in the case of the high power lamp in which the temperature of the ends of the feeder body is easily increased, it is unsuitable to operate the arc tube in a nitrogen atmosphere.

Furthermore, in the configuration in which the ends of the arc tube are sealed with the plug body having an external lead wire that passes through the inside thereof, the bonding between the external lead wire and the plug body is not sufficient and the filled materials leak to the outside from the arc tube along the lead wire, so that the lamp voltage during the lamp operation is significantly lowered.

Furthermore, in the configuration in which the end of the arc tube is sealed with the conductive cermet, since the front surface of the sealing material is close to the discharge space and so has a high temperature, the sealing material is softened, or a sealing material reacts with the filled material. Consequently, the lamp characteristics are significantly deteriorated for a short time.

Furthermore, when the luminous efficiency of the conventional lamps were respectively examined, they were low. For example, the luminous efficiency was about 80 (lm/M) for a high-color-rendering lamp. Although a lamp having a higher luminous efficiency has been desired, improvement of the luminous efficiency has not been considered in the conventional metal vapor discharge lamps.

Furthermore, the luminous flux rise time (time required to obtain the luminous flux of 90% with respect to that of the steady state) at the initial time of the lamp operation was as long as about 13 to 15 minutes. Thus, although the lamp having a shorter luminous flux rise time has been desired, improvement of the luminous flux rise property has not been considered in the conventional metal vapor discharge lamps.

SUMMARY OF THE INVENTION

It is an object of the present invention to solve the problems of the prior art. That is, the object of the present invention is to provide a metal vapor discharge lamp having a highly reliable sealing portion realizing the stable lamp characteristics during the lamp operation, and being capable of improving the luminous efficiency and of improving the luminous flux rise property at the initial time of the lamp operation.

According to the present invention, a metal vapor discharge lamp has an arc tube including a discharge portion composed of translucent ceramic in which a discharge metal is filled and a pair of electrodes is disposed; small tubular portions composed of ceramic coupled to both ends of the discharge portion; feeder bodies inserted into the small tubular portions; and a sealing material sealing the gap between the feeder body and the small tubular portion at the end portion opposite to the discharge portion. The surfaces including the respective end faces of the small tubular portions define a discharge space in cooperation with the inner surface of the discharge portion. The feeder bodies are composed of a conductive cermet and the end portions thereof are connected to the respective electrodes. The ends of the conductive cermets on the side opposite to the discharge space extend at least to the ends of the small tubular portions. The temperature of the end face of the sealing material on the discharge space side during the lamp operation is not more than 800° C.

According to such a configuration, the bonding strength at the interface between the sealing material and the small tubular portion and conductive cermet in the sealed portion is enhanced and the air-tightness is maintained for a long time. Consequently, when the lamp power is as high as 150 Watt or more, a metal vapor discharge lamp having a highly reliable sealed portion capable of preventing the occurrence of cracks can be realized.

Furthermore, with the configuration in which the temperature of the end face of the sealing material on the discharge space side is limited, the reaction between the sealing material using a glass frit etc. and the filled material can be inhibited. Thus, the metal vapor discharge lamp having the stable lamp characteristics during the lifetime of the lamp can be realized. In addition, since as the feeder body, the conductive cermet is used instead of Nb etc. reacting with nitrogen at high temperatures, nitrogen can be filled in the outer tube in order to reduce the temperature of the sealed portion. Thereby, it is possible to cause a loss of heat at the sealed portion by nitrogen, to lower the temperature of the sealing material and to inhibit the reaction.

As mentioned above, with such a configuration, the stable lamp characteristics can be obtained over the long period of lamp operation. However, the present invention further realizes the metal vapor discharge lamp having a high luminous efficiency and an excellent rise property. More specifically, the present inventor investigated the cause of the deterioration of the luminous efficiency in the conventional metal vapor discharge lamps, and found that the cause was in the heat loss from the discharge space. Also, the present inventor found that the factor to improve the luminous flux rise property was related to the temperature of the filled material. Therefore, the present invention described below is based on such findings.

It is preferable in the above-mentioned configuration that the length L (mm) between the end face of the sealing material on the discharge space side and the discharge space is (3/115)P+355/115 (mm) or more, wherein P denotes the lamp power in watts. Thus, the temperature of the end face of the sealing material on the discharge space side can be 800° C. or less. Consequently, the metal vapor discharge lamp in which the lamp characteristics are little changed over the long period of lamp operation can be obtained.

It is preferable that the thermal conductivity of the conductive cermet at 20° C. is 0.28 (cal/cm·sec·deg) or less. Thus, the heat loss caused by heat conduction via the conductive cermet out of the discharge space can be reduced.

It is preferable that the outer diameter r (mm) of the conducting cermet is $4.9\times10^{-3}P+0.53$ (mm) or less, wherein P denotes the lamp power in watts. Thus, a higher luminous efficiency can be obtained compared to the conventional lamps.

It is preferable that the specific resistance value of the conductive cermet at 20° C. is $10.0\times10^{-8}$ Ωm or more and $25.0\times10^{-8}$ Ωm or less. Thus, the temperature of the filled material can be increased promptly at the initial time of the operation of the metal vapor discharge lamp.

Furthermore, it is preferable that the metal vapor discharge lamp includes a heat reserving cover enveloping the small tubular portion. Thus, the reaction between the filled material and the sealing material can be inhibited by adjusting the temperature of the filled material, so that a stable lifetime can be obtained and the desired light color can be obtained.

It is preferable that the arc tube is provided inside the outer tube and nitrogen is filled in the outer tube. Thus, the temperature of the sealed portion can be lowered and the stable lamp characteristics can be obtained during the lifetime of the lamp.

DESCRIPTION OF THE PREFERRED EMBODIMENTS

Hereinafter, the present invention will be described by way of preferred embodiments with reference to the accompanying drawings.

Figure 1:
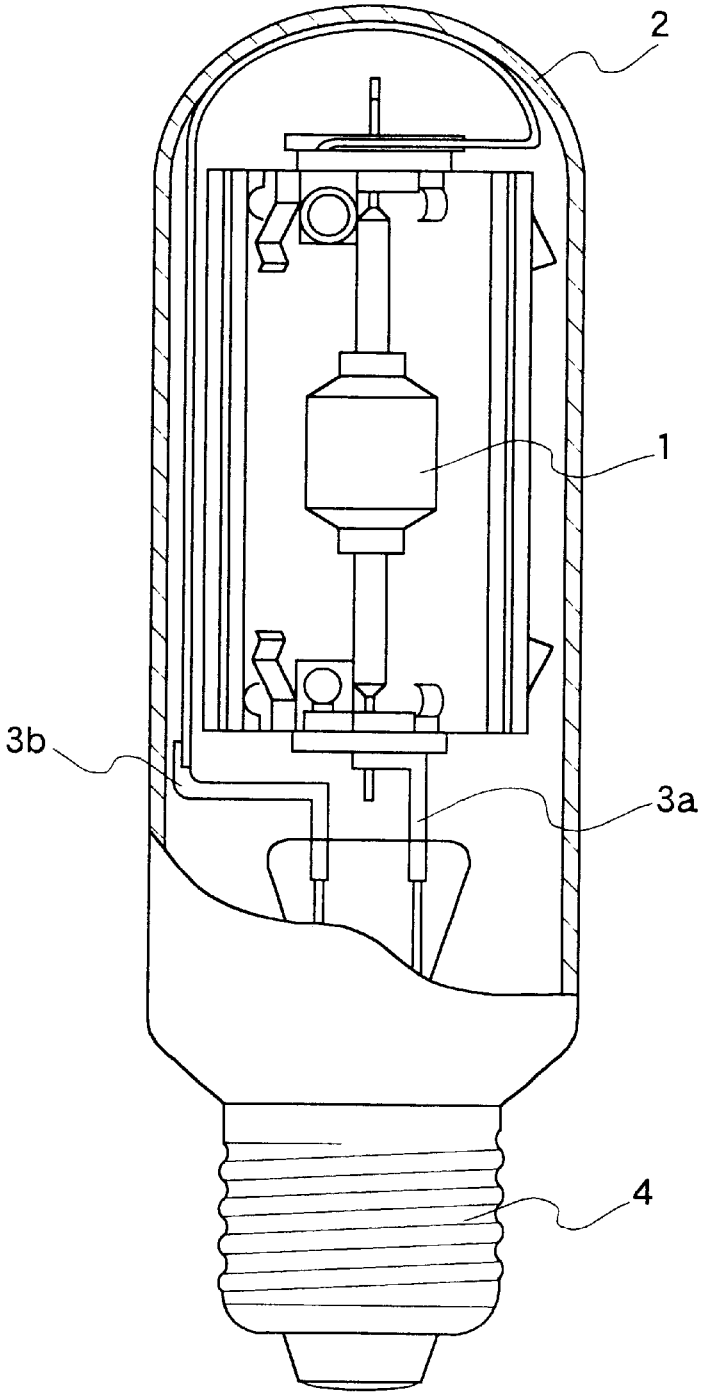
FIG. 1 is a front view of a metal vapor discharge lamp according to a first embodiment of the present invention.

FIG. 1 shows a 150W metal vapor discharge lamp according to a first embodiment of the present invention. In FIG. 1, numeral 1 denotes an arc tube made of translucent ceramics, for example, polycrystalline alumina. The arc tube 1 is surrounded by an outer tube 2. The arc tube 1 is fixed inside the outer tube 2 by metal wires 3*a* and 3*b*. Inside the outer tube 2, nitrogen of a predetermined pressure is filled. Moreover, a base 4 is attached to the outer tube 2 and the base 4 is connected to the metal wires 3*a* and 3*b*.

Figure 2:
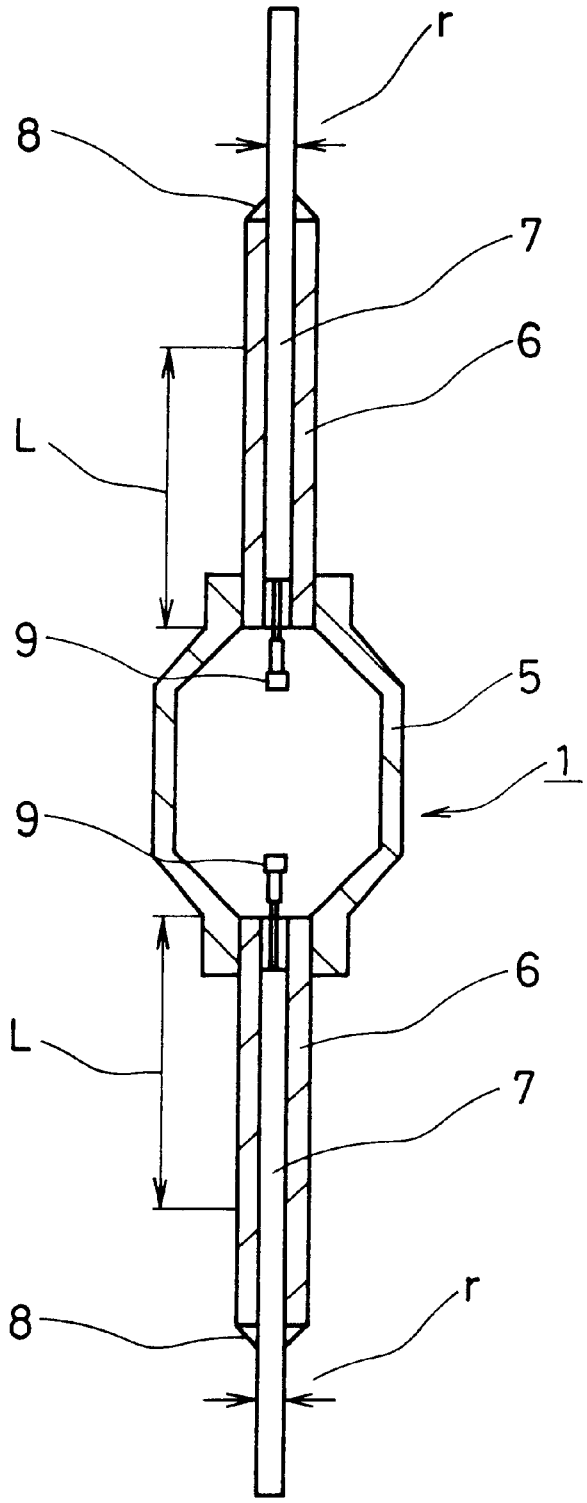
FIG. 2 is a front view of the arc tube of the metal vapor discharge lamp in FIG. 1 with a part broken away.

As shown in FIG. 2, the arc tube 1 has a main tube portion 5 that is a discharge portion having a maximum outer diameter of, for example, 10 mm and small tubular portions 6 having an inner diameter of, for example, 1.0 mm provided at both ends of the main tube portion 5. The small tubular portions 6 are not necessarily translucent. Furthermore, a certain amount of mercury, a noble gas for a starting gas such as, for example, argon gas, and metal halides such as dysprosium iodide, thallium iodide, sodium iodide, or the like are filled in the arc tube 1.

Inside each small tubular portion 6, a conductive cermet 7 that is a feeder body having an outer diameter of, for example, 0.9 mm is inserted. Each small tubular portion 6 and a conductive cermet 7 are sealed with a glass frit 8. Electrodes 9 are connected to the ends of the conductive cermets 7 facing the main tube portion 5. The electrodes are arranged so that they are opposing each other in the main tube portion 5. The length between both electrodes 9 may be 10 mm.

The conductive cermet 7 is produced by sintering a mixture of molybdenum powder or tungsten powder and alumina powder. The coefficient of thermal expansion of the conductive cermet 7 is substantially the same as that of the arc tube 1. The conductive cermet 7 used in this embodiment may be a sintered mixture in which molybdenum and alumina are mixed at the weight ratio of 50:50 and has the coefficient of thermal expansion of about $7.0\times10^{-6}$. However, when the power of the arc tube 1 becomes higher, for example, 250W or 400W, it is desirable to increase the mixing ratio of alumina and to bring the coefficient of thermal expansion of the conductive cermet closer to that of alumina.

The conductive cermets 7 protrude to the outside of the arc tube by only 10 mm, for example, in length from the end of the small tubular portion 6 and are directly welded to the metal wires 3*a* and 3*b*, respectively.

In this embodiment, the conductive cermets 7 are protruded from the end of the small tubular portions 6 by only 10 mm in length, however, the conductive cermets 7 may be flush with the end face of the small tubular portion 6. In the latter case, it is necessary to connect the external lead wire to the end of the conductive cermet 7 at the opposite side to which the electrodes 9 are connected. When the external lead wire is disposed inside the small tubular portion, since the bonding strength is weak at the interface between the external lead wire and the glass frit 8 that is a sealing material, leaks from the arc tube may occur. Therefore, it is preferable that the conductive cermet 7 is protruded from the end of the small tubular portion 6.

Figure 3:
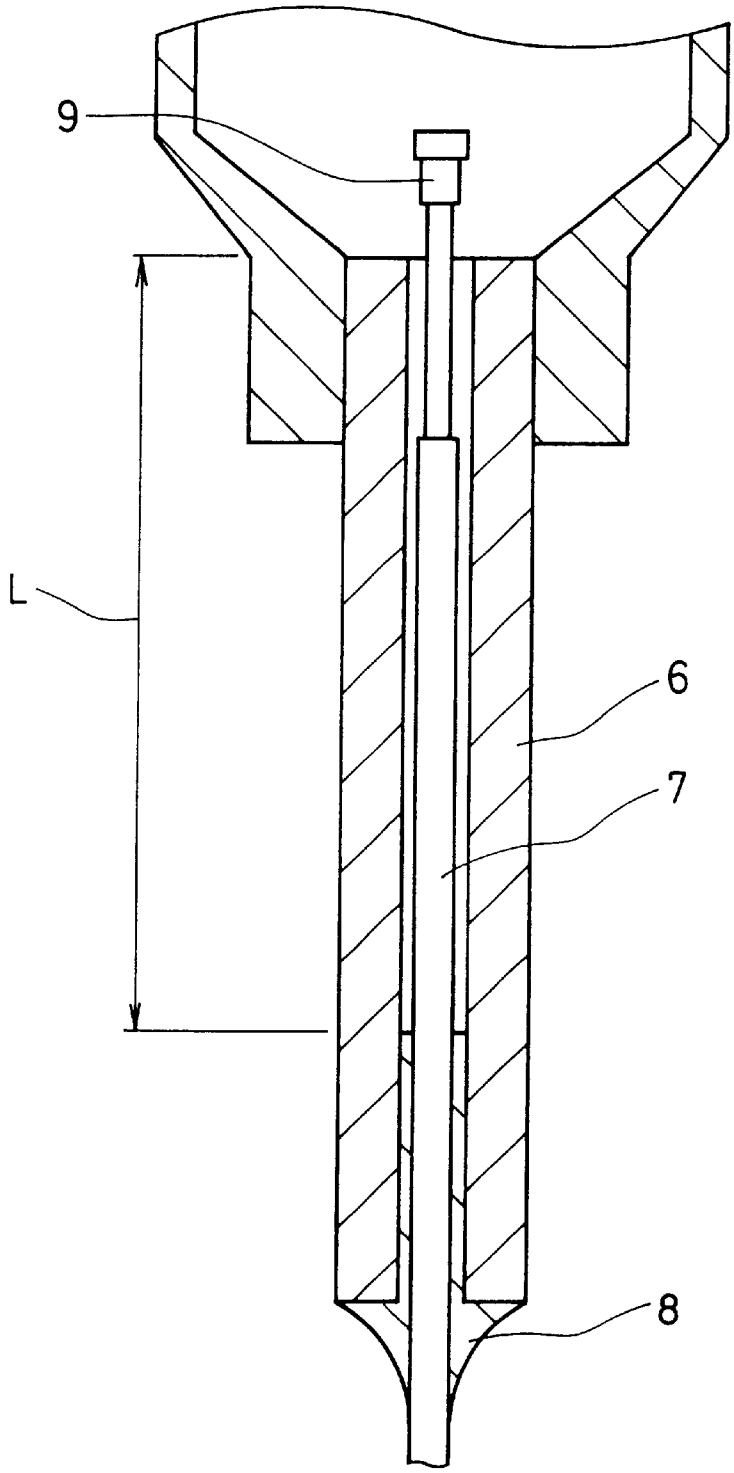
FIG. 3 is an enlarged cross-sectional view of a part of the arc tube in FIG. 2.

The glass frit 8 is made of dysprosium oxide, alumina, silica, and the like. As shown in FIG. 3, the glass frit 8 is poured into the gap between the inner surface of the small tubular portion 6 and the outer surface of the conductive cermet 7 so that length L between the end face of the glass frit 8 on the discharge space side and the end face of the arc tube is, for example, 7 mm. The discharge space means a space defined by the inner surface of the main tube portion 5 and the surface including the end faces of the small tubular portions 6 on the side of the main tube portion 5.

Figure 4:
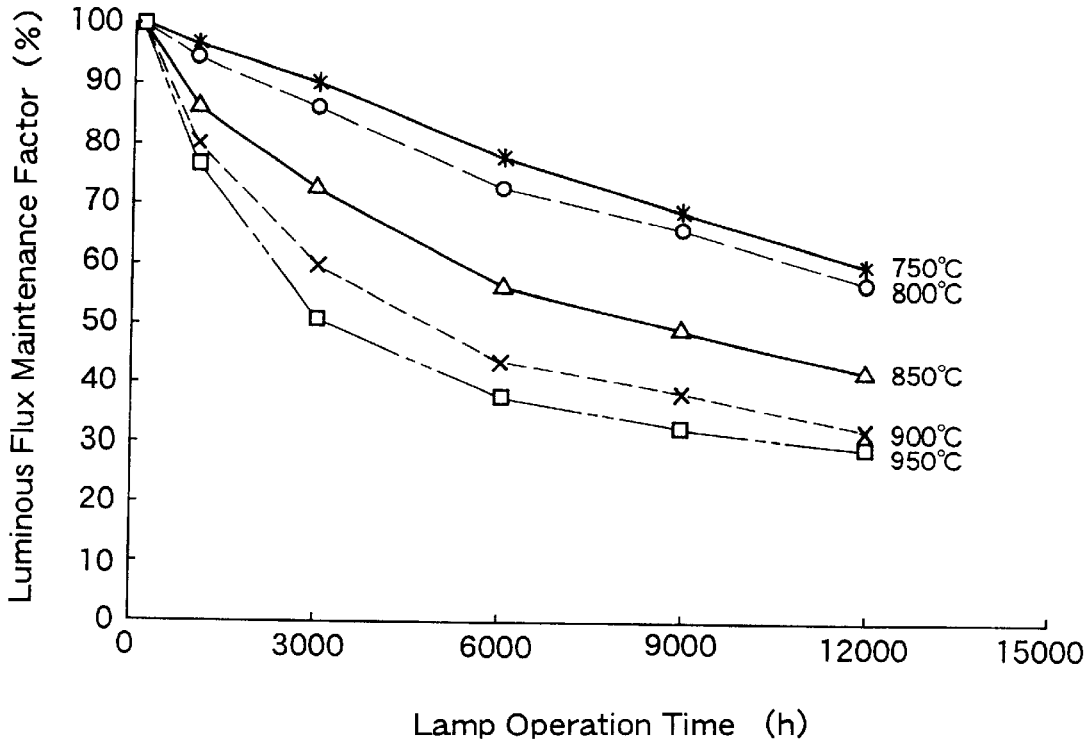
FIG. 4 is a graph showing the relationship between the temperature of the end face of the frit on the side of discharge space and the luminous flux maintenance factor.

The luminous flux maintenance factor during the lamp operation of each of 100 metal vapor discharge lamps of this embodiment was examined while varying temperature of the end face of the glass frit 8 on the discharge space side, at 750° C., 800° C., 850° C., 900° C. and 950° C. The results are shown in FIG. 4. The temperatures were calculated from the data of temperature measured by a platinum-platinum rhodium thermocouple attached to the outer surface of the small tubular portion 6 at the end of the glass frit 8 on the discharge space side. The calculation was based on the wall thickness of the small tubular portion 6 and the thermal conductivity of aluminum. In FIG. 4, the mark * indicates the case where the glass frit 8 is at 750° C.; ○ at 800° C.; Δ at 850° C.; X at 900° C.; and □ at 950° C., respectively.

As is apparent from FIG. 4, when the temperature of the glass frit 8 is 850° C. or higher, after a lamp operating time of 6000 hours, that is, the rating lifetime, the luminous flux maintenance factor is less than 60%. When the cross section of the sealed portion at this time was observed, it was confirmed that the end face of the frit was vigorously eroded by the filled material. This caused the loss of the discharge metal and lowered the luminous flux maintenance factor.

Furthermore, the percentage of leaks from the arc tube was examined with respect to the lamp operating time at each temperature. The results are shown in Table 1. It was confirmed from the results that: when the temperature was 950° C., leaks occurred in 50% or more of lamps after an operating time of 6000 hours; when the temperature was 850° C., the lamp voltage gradually dropped after an operating time of 7000 hours or later and leaks occurred and the lamps turned off in 30% or more after an operating time of 9000 hours; and when the temperature was 800° C. or less, even after 6000 of hours operating, the luminous flux maintenance factor was secured to be 70% or more, 70% of lamps operated for 9000 hours and 50% of lamps operated for 12000 hours or longer without occurrence of leaks.

TABLE 1

| Temperature | Occurrence of leaks (%) | | | |
|---|---|---|---|---|
| (° C.) | 6000 hrs | 9000 hrs | 12000 hrs | Evaluation |
| 750 | 0 | 11 | 26 | ○ |
| 800 | 0 | 22 | 33 | ○ |
| 850 | 18 | 38 | 55 | X |
| 900 | 32 | 52 | 79 | X |
| 950 | 52 | 71 | 90 | X |

In the above-mentioned embodiment, the 150W metal vapor discharge lamp was described. The same results were obtained in the metal vapor discharge lamps having the lamp power of 35W, 70W, 100W, 250W, 400W, etc.

When niobium (Nb), instead of the conductive cermet 7, is used for the feeder body, the bonding at the interface between the glass frit 8 and Nb is not so strong as the bonding at the interface between the conductive cermet 7 and the glass frit 8, so that the air-tightness is not very reliable over the long lifetime. Furthermore, in the lamp having a power of 150W or more, for example, the 250W lamp, the rod diameter of the feeder body becomes large, so that micro cracks occur between Nb having the coefficient of thermal expansion of $7.2\times10^{-6}$ and alumina having the coefficient of thermal expansion of $8.0\times10^{-6}$. The micro cracks grow during the lamp operation and leaks occur in the arc tube. When the life test was conducted under the conditions where the lamp power was 250W, the temperature of the frit was 800° C., and Nb was used for the feeder body, cracks occurred in 3 lamps out of 100 lamps after an operating time of 2000 hours and leaks occurred in 30 lamps after an operating time of 6000 hours. When the cross section of the sealed portion of the lamp in which leaks occurred was observed, it was confirmed that many micro cracks occurred in the glass frit bridging the gap between Nb and alumina. Some of the micro cracks were confirmed to grow to the end of the sealed portion and iodine was detected between the cracks.

On the contrary, in the lamp of the present invention, 70% or more of lamps operated for 9000 hours without the occurrence of leaks. This is thought to occur because the coefficient of thermal expansion of the cermet used in the present invention is $7.5\times10^{-6}$ and can be brought closer to that of translucent alumina as compared to Nb, and thereby a stronger air-tightness in the sealed portion can be obtained as compared to Nb. Furthermore, since nitrogen is filled inside the outer tube 2 of the lamp in order to reduce the temperature of the sealed portion, in the lamp using Nb for the feeder body, Nb is vigorously deteriorated after an operating time of 3000 hours or later. This deterioration is thought to be one of the causes of leaks in the arc tube.

Furthermore, the luminous efficiency of the metal vapor discharge lamp of the embodiment was measured. The measurement was made by using the conductive cermets having varied the thermal conductivity in accordance with Examples 1 to 3 of Table 2. The results are shown in Table 2. The conductive cermet 7 having the thermal conductivity of Examples 1 to 3 and Comparative Example 1 were produced by sintering a mixed powder including molybdenum powder and alumina powder while varying the mixing ratio. The conductive cermet 7 of Comparative Example 1 has the largest thermal conductivity in the conductive cermets that actually can be produced by using these materials. Furthermore, the conductive cermet 7 of Comparative Example 2 is produced by sintering a mixed powder of tungsten powder and alumina powder. It has the largest thermal conductivity in the conductive cermets that actually can be produced by using these materials.

In this connection, the thermal conductivity herein referred to is that measured at 20° C. unless otherwise noted.

TABLE 2

| | Thermal conductivity (cal/cm · sec · deg) | Luminous efficiency (lm/W) | Evaluation |
|---|---|---|---|
| Example 1 | 0.15 | 102 | ○ |
| Example 2 | 0.20 | 100 | ○ |

TABLE 2-continued

| | Thermal conductivity (cal/cm · sec · deg) | Luminous efficiency (lm/W) | Evaluation |
|---|---|---|---|
| Example 3 | 0.28 | 95 | ○ |
| Comparative Example 1 | 0.33 | 90 | X |
| Comparative Example 2 | 0.38 | 88 | X |

The luminous efficiency of the conventional metal vapor discharge lamp, for example, a high color rendering lamp is generally about 80 (lm/W). On the other hand, as shown in Table 2, in the lamp using the conductive cermet 7 having a thermal conductivity of 0.28 (cal/cm·sec·deg) or less, the luminous efficiency was 95 (lm/W) or more. Practically sufficient luminous efficiency is 90 (lm/W) or more. On the other hand, when the conductive cermet 7 having a thermal conductivity of more than 0.28 (cal/cm·sec·deg) and not more than 0.33 (cal/cm·sec·deg) was used, cracks easily occurred in the glass frit 8, while the practically sufficient luminous efficiency was obtained. Furthermore, when the conductive cermet having a thermal conductivity of more than 0.33 (cal/cm·sec·deg) was used, the luminous efficiency was not practically sufficient and cracks easily occurred in the glass frit 8.

As seen from this result, the reason why cracks easily occurred in the glass frit 8 is: as the thermal conductivity is increased, the ratio of alumina contained in the conductive cermet 7 is reduced, so that the difference in the coefficient of thermal expansion between the conductive cermet 7 and the arc tube 1 is increased. Furthermore, the occurrence of cracks in the glass frit 8 causes the occurrence of leaks in the sealed portion of the small tubular portion 6 and the conductive cermet 7.

Thus, setting the thermal conductivity to be 0.28 (cal/cm·sec·deg) or less makes it possible to improve the luminous efficiency about 10% or more compared to that of the conventional lamps, and to prevent the occurrence of cracks in the glass frit 8. This is because the thermal conductivity of the conductive cermet 7 is small and so the heat loss caused by heat condition via the conductive cermet 7 out of the discharge space can be reduced. It is also because the ratio of alumina contained in the conductive cermet 7 is increased, so that the coefficient of thermal expansion can be made to be substantially the same as that of the arc tube 1. The thermal conductivity is preferably as small as possible.

However, even if the thermal conductivity is small, when the outer diameter r (mm) of the conductive cermet 7 is large, the heat loss is increased. Therefore, in order to solve such a problem, the luminous efficiency was examined in the 150W metal vapor discharge lamp using the conductive cermet 7 having the thermal conductivity of 0.28 (cal/cm·sec·deg) while varying the outer diameter r in accordance with Examples 3 and 4 and Comparative Examples 3 to 6 of Table 3. The results are shown in Table 3.

TABLE 3

| | Outer diameter r (mm) | Luminous efficiency (lm/W) | Evaluation |
|---|---|---|---|
| Example 3 | 0.9 | 95 | ○ |
| Example 4 | 1.265 | 90 | ○ |
| Comparative Example 3 | 2.2 | 85 | X |

TABLE 3-continued

| | Outer diameter r (mm) | Luminous efficiency (lm/W) | Evaluation |
|---|---|---|---|
| Comparative Example 4 | 2.7 | 81 | X |
| Comparative Example 5 | 2.9 | 80 | X |
| Comparative Example 6 | 3.4 | 72 | X |

As shown in Table 3, when the conductive cermet having an outer diameter r of 1.265 mm or less was used, the luminous efficiency was 90 (lm/W) or more. On the other hand, when the conductive cermet 7 having an outer diameter r of more than 1.265 mm was used, the practically sufficient luminous efficiency could not be obtained.

This shows that setting the outer diameter r of the conductive cermet 7 to be 1.265 mm or less makes it possible to improve the luminous efficiency at least 10% compared to the usual luminous efficiency of the conventional high color rendering metal vapor discharge lamp. This is because the heat loss caused by heat conduction via the conductive cermet 7 out of the discharge space can be reduced. Furthermore, since the metal vapor discharge lamp having higher luminous efficiency is practically desired, it is preferable that the outer diameter r is set to be 0.9 mm or less so that the luminous efficiency is 95 (lm/W) or more.

As the outer diameter r is changed, the inner diameter of the small tubular portion 6 is changed. When the outer diameter r is too small, the conductive cermet 7 cannot resist against the current flowing in it and the voltage generated, whereby the conductive cermet 7 is damaged. Consequently, the conductive cermet 7 has to have an outer diameter so that it can resist the current and the voltage.

Furthermore, as mentioned above, it was confirmed that the temperature of the glass frit 8 becomes 800° C. or higher, the reaction between the glass frit 8 and a metal halide was promoted. As a result, the glass frit 8 was deteriorated and leaks occurred in the sealed portion between the small tubular portion 6 and the conductive cermet 7. Therefore, in order to solve such a problem, as shown in Table 4, the temperature of the end face of the glass frit 8 on the discharge space side and existence of leaks after an operating time of 3000 hours were examined by using the metal vapor discharge lamps having varied length L (mm) between the end face of the glass frit 8 on the discharge space side and the discharge space. The experiments employed a 150W metal vapor discharge lamp of the above-mentioned structure using the conductive cermet 7 having an outer diameter of 0.9 mm and thermal conductivity of 0.28 (cal/cm·sec·deg). Table 4 shows the evaluation of the experiment results.

TABLE 4

| L(mm) | Temperature (° C.) | Occurrence of leaks (%) | Evaluation |
|---|---|---|---|
| 8.0 | 750 | 0 | ○ |
| 7.0 | 800 | 0 | ○ |
| 6.0 | 850 | 2 | X |
| 5.0 | 880 | 7 | X |
| 3.0 | 960 | 33 | X |
| 1.0 | 1000 | 90 | X |

As shown in Table 4, setting length L to be 7 mm or more makes it possible to prevent the occurrence of leaks. On the other hand, when length L is 6 mm or less, leaks occurred. This is because, as mentioned above, the predetermined distance is secured between the end face of the glass frit 8 on the side of discharge space and the discharge space where the temperature is increased during the lamp operation, so that the glass frit 8 can be kept at 800° C. or less, and chemical reaction between the glass frit 8 and the metal halide is inhibited.

In the above-mentioned embodiment, the 150W metal vapor discharge lamp was described. However, the same results are obtained when the experiments are carried out in, for example, metal vapor discharge lamps having the lamp power of 35W, 70W, 100W, 250W and 400W. In such cases, the luminous efficiency can be improved when the outer diameter r (mm) of each metal vapor discharge lamp is not more than the value expressed by $4.9\times10^{-3}$ P+0.53, wherein P denotes the lamp power in watts from 35W to 400W. Similarly, when length L (mm) is not less than the value expressed by (3/115)P+355/115, the occurrence of leaks can be prevented.

Next, the conductive cermets having the different specific resistance values of Examples 5 and 6 and Comparative Examples 7 and 8 were prepared. The specific resistance values were varied by changing the ratio of molybdenum contained in the conductive cermet 7. The luminous flux rise time (time required to obtain the luminous flux of 90% with respect to that of the steady state) at the initial time of the lamp operation and the luminous flux maintenance factor after an operating time of 6000 hours were examined in the metal vapor discharge lamps using the above-prepared conductive cermets.

The specific resistance values herein referred to are those at 20° C. unless otherwise noted.

TABLE 5

| | Specific resistance value (Ωm) | Luminous flux rise time (min.) | Luminous flux maintenance factor (%) | Evaluation |
|---|---|---|---|---|
| Comparative Example 7 | $5.6\times10^{-8}$ | 12 | 75 | X |
| Example 5 | $10.0\times10^{-8}$ | 10 | 72 | ○ |
| Example 6 | $25.0\times10^{-8}$ | 8 | 70 | ○ |
| Comparative Example 8 | $30.0\times10^{-8}$ | 7 | 60 | X |

The luminous flux rise time of the conventional metal vapor discharge lamp is usually about 13 to 15 minutes. On the other hand, as shown in Table 5, when the conductive cermet 7 having the specific resistance value of $10.0\times10^{-8}$ Ωm or more was used, the luminous flux rise time was 10 minutes or less. A practically sufficient luminous flux rise time is 10 minutes or less. On the other hand, when the conductive cermet 7 of the comparative example 7 having a specific resistance value of less than $10.0\times10^{-8}$ Ωm was used, the luminous flux rise time was not practically sufficient.

This is because the amount of heat generated by the conductive cermet 7 is increased as the specific resistance value is increased, thus making it possible to promptly raise the temperature of the sealed materials in the vicinity of the coldest portion (the gap between the inner surface of the small tubular portion 6 and the outer surface of the conductive cermet 7) of the arc tube 1.

However, as shown in Table 5, in the comparative example 8 using the conductive cermet having the specific resistance value of $30.0\times10^{-8}$ Ωm or more, the luminous flux maintenance factor after the lamp operating time of 6000 hours dropped to 60%. This is because a too large specific resistance value extremely raises the temperature of the sealed portion between the small tubular portion 6 and the conductive cermet 7, and the metal halide is attached to the end face of the glass frit 8 on the discharge space side, so that the amount of the metal halides that contribute to discharging is reduced. In general, a practically sufficient luminous flux maintenance factor is 70% or more. Therefore, it is preferable that the specific resistance value is $25.0\times10^{-8}$ Ωm or less.

In the above-mentioned embodiment, the case where molybdenum was used for the constituent materials of the conductive cermet 7 was described. However, the materials for the conducting material 7 are not limited to molybdenum alone, and materials other than molybdenum, for example, tungsten, may be used.

Figure 5:
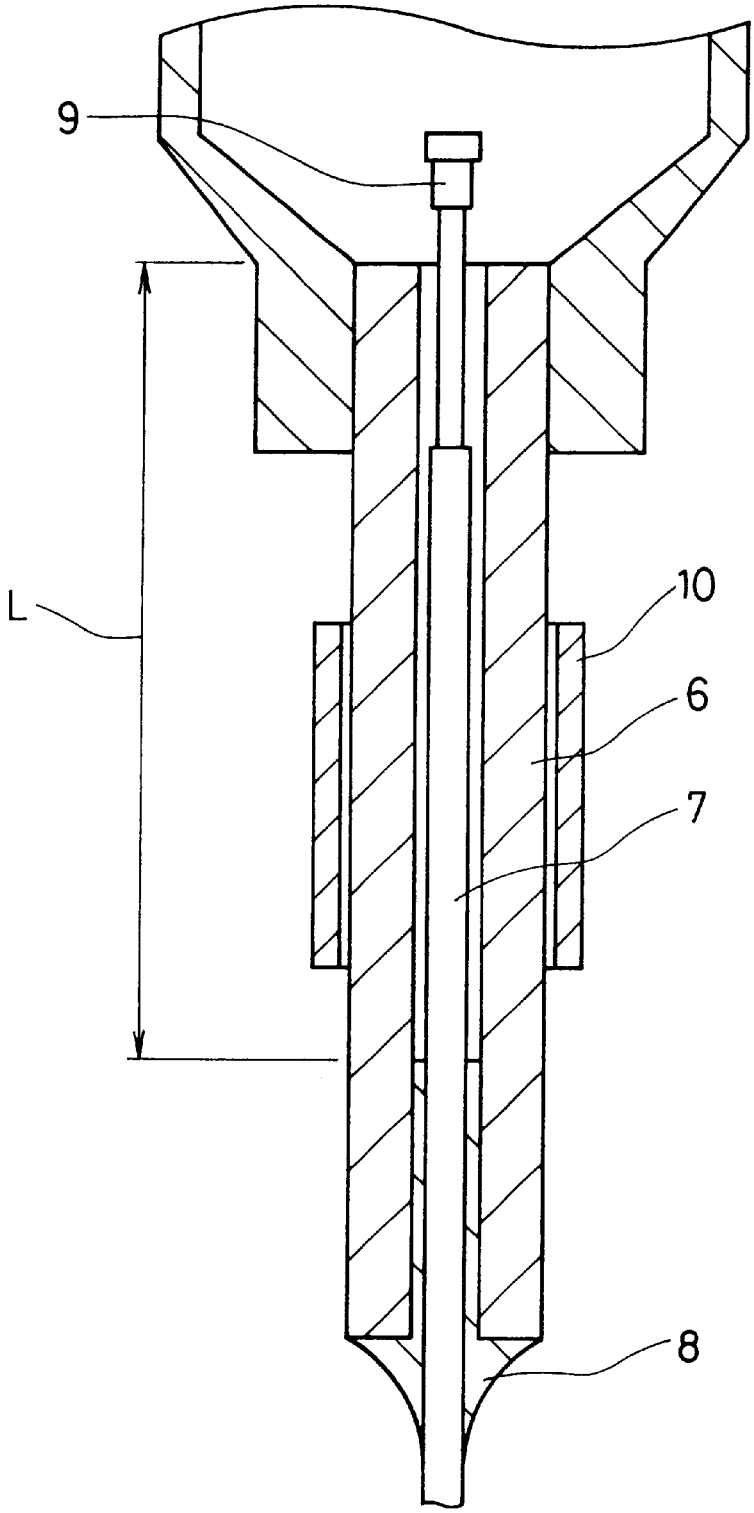
FIG. 5 is a partial cross-sectional view of the arc tube of a metal vapor discharge lamp according to a second embodiment of the present invention.
Figure 6:
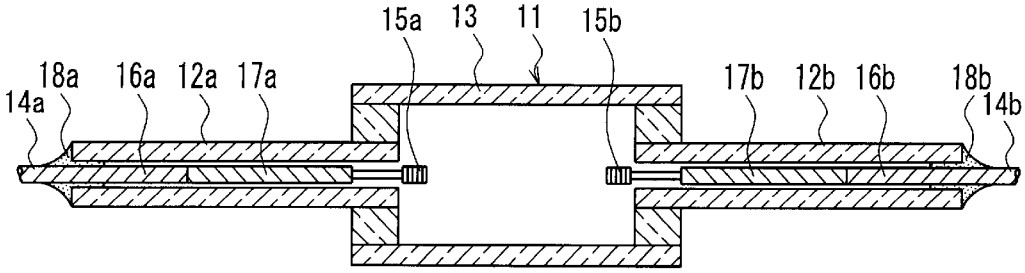
FIG. 6 PRIOR ART
FIG. 6 is a cross-sectional view of a conventional lamp 1.
Figure 7:
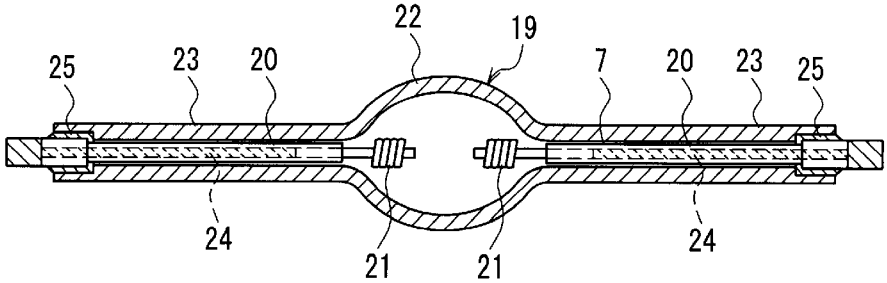
FIG. 7 PRIOR ART
FIG. 7 is a cross-sectional view of a conventional lamp 2.
Figure 8:
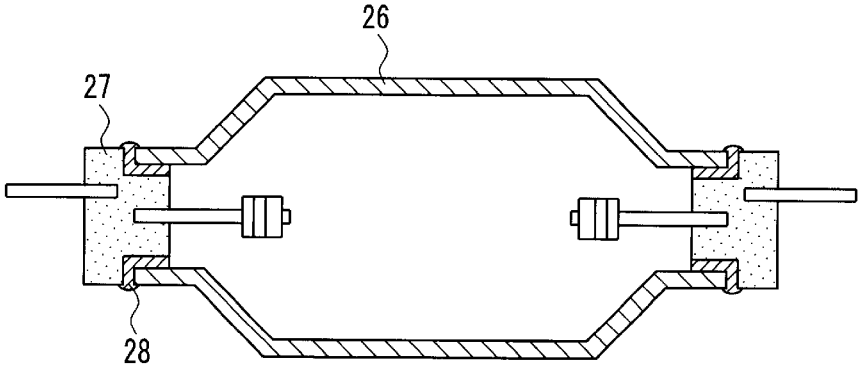
FIG. 8 PRIOR ART
FIG. 8 is a cross-sectional view of a conventional lamp 3.

FIG. 5 shows a 150W metal vapor discharge lamp according to a second embodiment of the present invention. The lamp of the second embodiment includes a heat reserving cover 10 at the outer circumference of the small tubular portion 6 in addition to the configuration of the metal vapor discharge lamp of the first embodiment. The heat reserving cover 10 is, for example, 3.1 mm in inner diameter and 5 mm in length and is made of metal such as molybdenum. In this embodiment, the length L between the end face of the glass frit 8 on the discharge space side and the discharge space was 8 mm and the temperature of the end face was 700° C. Thus, the stable lamp characteristics for the long operating time of lamp could be obtained.

Furthermore, by disposing the heat reserving cover 10 on the discharge space side seen from the end face of the glass frit 8 on the discharge space side as shown in FIG. 5, the temperature of the filled material was kept warm. Thereby, the same color property as the lamp in which the temperature of the end face of the glass frit on the discharge space side is 800° C. could be obtained with the same amount of filled materials being used.

When the heat reserving cover 10 was extended to the end face of the glass frit 8 on the discharge space side, the temperature of the glass frit 8 was increased, causing the occurrence of leaks in the arc tube.

Furthermore, with such a configuration, since it is not necessary to fill an amount of metal halides greater than the amount evaporating during the lamp operation as in the conventional metal vapor discharge lamp, the filling amount of metal halides can be reduced, and the cost can be reduced.

Furthermore, although the above-description is directed to the case where nitrogen was filled in the outer tube 2, the outer tube 2 may be under vacuum. In this case, since the temperature of the sealed portion of the small tubular portion 6 is increased, it is preferable that length L between the glass frit 8 and the discharge space is further increased.

As mentioned above, the present invention can provide the metal vapor discharge lamp which has a high reliable sealed portion capable of realizing the stable lamp characteristics during the long lifetime of the lamp and in which the luminous efficiency can be improved as well as the luminous flux rise property at the initial time of the lamp operation.

The invention may be embodied in other specific forms without departing from the spirit or essential characteristics thereof The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A metal vapor discharge lamp having an arc tube comprising:

a discharge portion composed of translucent ceramic in which a discharge metal is filled and a pair of electrodes is disposed;

small tubular portions composed of ceramic coupled to both ends of said discharge portion, the surfaces including the respective end faces of the small tubular portions defining a discharge space in cooperation with the inner surface of said discharge portion;

feeder bodies composed of a conductive cermet inserted into said small tubular portions, the end portion of the feeder bodies being connected to respective said electrodes; and a sealing material of a glass frit for sealing the gap between said feeder body and said small tubular portion at the end portion opposite to said discharge space, wherein the ends of the conductive cermets and the end face of the glass frit on the discharge space side are recessed from the discharge space, the ends of the conductive cermets on the side opposite to said discharge space extend at least to the ends of said small tubular portions, and the temperature of the end face of said sealing material on the discharge space side during the lamp operation is not more than 800° C.

2. The metal vapor discharge lamp according to claim 1, wherein a length L (mm) between the end face of said sealing material on the discharge space side and the discharge space is (3/115)P+355/115 (mm) or more, wherein P denotes the lamp power in watts.

3. The metal vapor discharge lamp according to claim 1 or 2, wherein the thermal conductivity of said conductive cermet at 20° C. is 0.28 (cal/cm·sec·deg) or less.

4. The metal vapor discharge lamp according to claim 3, wherein the outer diameter r(mm) of said conducing cermet is $4.9\times10^{-3}$P+0.53 (mm) or less, wherein P denotes the lamp power in watts.

5. The metal vapor discharge lamp according to claim 1, wherein the specific resistance value of said conductive cermet at 20° C. is $10.0\times10^{-8}$ Ωm or more and $25.0\times10^{-8}$ Ωm or less.

6. The metal vapor discharge lamp according to claim 1, further comprising a heat reserving cover enveloping said small tubular portion.

7. The metal vapor discharge lamp according to claim 1, wherein said arc tube is provided inside the outer tube and nitrogen is sealed in said outer tube.

* * * * *